US009755331B2

(12) United States Patent
Swan

(10) Patent No.: US 9,755,331 B2
(45) Date of Patent: Sep. 5, 2017

(54) ELECTRICAL WIRE CONNECTOR

(71) Applicant: William Ernest Swan, New Ulm, MN (US)

(72) Inventor: William Ernest Swan, New Ulm, MN (US)

( * ) Notice: Subject to any disclaimer, the term of this patent is extended or adjusted under 35 U.S.C. 154(b) by 0 days.

(21) Appl. No.: 14/967,077

(22) Filed: Dec. 11, 2015

(65) Prior Publication Data

US 2016/0197414 A1 Jul. 7, 2016

Related U.S. Application Data

(60) Provisional application No. 62/100,776, filed on Jan. 7, 2015.

(51) Int. Cl.
*H01R 11/24* (2006.01)
*H01R 4/72* (2006.01)
*H01R 13/52* (2006.01)

(52) U.S. Cl.
CPC ..... *H01R 11/24* (2013.01); *H01R 4/72* (2013.01); *H01R 13/5216* (2013.01)

(58) Field of Classification Search
CPC ..... H01R 11/24; H01R 4/48; Y10T 24/3433; Y10T 24/3435; Y10T 24/3437; Y10T 24/3443
See application file for complete search history.

(56) References Cited

U.S. PATENT DOCUMENTS 1,521,197 A * 12/1924 Lewis ..... H01R 11/24 439/822
2,022,669 A 12/1935 Keefe
2,147,160 A * 2/1939 Hagist ..... H01R 4/363 24/135 N
2,866,958 A 12/1958 Postell
3,368,187 A 2/1968 Faul et al.
3,716,079 A * 2/1973 Marshall ..... B21F 15/04 140/120
3,814,139 A * 6/1974 Loyd ..... H01R 4/72 138/141
3,821,689 A 6/1974 Graham
4,268,104 A * 5/1981 Kidder ..... H01R 4/2412 439/164

(Continued)

*Primary Examiner* — Amy Cohen Johnson
*Assistant Examiner* — Oscar C Jimenez
(74) *Attorney, Agent, or Firm* — Michael A. Mochinski

(57) ABSTRACT

An electrical wire connector for electrically coupling together a plurality of electrical wires, which comprises a bridging member having a midsection interposed between a pair of sectional ends each having a lower jaw element integral thereto and an upper jaw element pivotally connected thereto to collectively form a clamp mechanism for receiving a bare portion of electrical wire. A torsion spring positioned between the lower and upper jaw elements serves to supply a downward clamping force that retains the electrical wire within the clamp mechanism. The clamp mechanism further includes a plurality of slots integrated within the structure of the lower and upper jaw elements for accepting therewithin an extended section of the bare portion of electrical wire to effect resistance of tensional forces applied thereto so as to provide for a permanent-like connection that maintains continuity through the electrical wire connector.

20 Claims, 8 Drawing Sheets

(56) References Cited

U.S. PATENT DOCUMENTS

| | | | | | |
|---|---|---|---|---|---|
| 4,629,274 | A * | 12/1986 | Pollock | H01R 4/5075 | 439/410 |
| 4,815,991 | A | 3/1989 | Bakke | | |
| 5,123,861 | A * | 6/1992 | Verge | H01R 11/24 | 439/141 |
| 5,774,950 | A | 7/1998 | Stout | | |
| 5,934,656 | A * | 8/1999 | Carder | B25B 5/06 | 269/152 |
| 6,623,314 | B1 * | 9/2003 | Cox | H01R 11/24 | 439/504 |
| 6,871,387 | B2 | 3/2005 | Cheng et al. | | |
| 8,272,612 | B2 * | 9/2012 | Thorpe | A24F 13/22 | 24/336 |
| 8,430,681 | B2 | 4/2013 | Wang et al. | | |
| 8,480,427 | B2 | 7/2013 | Marshalok | | |
| 2015/0064990 | A1 * | 3/2015 | Tsai | H01R 11/24 | 439/789 |

* cited by examiner

ELECTRICAL WIRE CONNECTOR

CROSS-REFERENCE TO RELATED APPLICATIONS

This application claims the benefit of U.S. Provisional Application No. 62/100,776, filed Jan. 7, 2015, entitled "Wire Connector," the disclosures of which, including all attached documents, are incorporated herein by reference in their entirety for all purposes.

FIELD OF THE INVENTION

The present invention is a device primarily directed to effect physical connection of one end of an electrical wire to one end of another electrical wire to the extent of fulfilling continuity along an electrical wire path. More specifically, the device offers a permanent-like connection of electrical wires irrespective of the gauge size and type, such as those categorically composed of multiple strands or a single strand or core.

BACKGROUND OF THE INVENTION

The mating of ends of two electrically conductive wires is an operation which, although it appears to be a relatively simple exercise, does, in fact, involve some degree of understanding and skill in order to fulfill a safe and reliable electrical connection. A loose wire connection, for instance, can cause arcing and overheating to the extent of starting a fire or causing other hazards, such as electrical shocks, as well as being a detriment to the flow of electricity for proper operation of electrical devices and appliances connected to an electrical circuit. The art employs numerous methods for connecting ends of electrical wires, some better than others in terms of simplicity, longevity and reliability.

As in most cases of fulfilling an electrical connection, ends of the electrical wire are initially stripped of their insulator by means of a wire-stripping tool, paying special attention not to nick the wire in the insulation stripping process. A nick can create a hot spot whenever the circuit is loaded, such that the spot can expand and contract with each heating and cooling cycle, and over time, effectively loosen the connection. Loose connections, whether they emanate from a nick in the wire or a failed connector, are precursors to arc faults, arc flash and fires in electrical systems. Following the insulator-stripping process, the ends of the electrical wires are placed together in a manner that yields continuity or unrestricted flow of electricity, mainly by means of engaging the two ends of the electrical wires in a semi-permanent or permanent manner.

By far the most common and simplistic form of making an electrical connection involves the twisting of the wire ends and tautly wrapping the exposed, twisted wire ends with an insulating tape. Although a quick operation that satisfactorily serves to accommodate varying gauge sizes and wire types, one can only imagine that this form of connection is possibly as good as the tape's ability to adequately adhere to the wire ends, and where there is profound movement of or pull on the wires, it is more likely than not that the electrical connection will become unduly compromised to the extent of realizing some of the previously mentioned problems.

Another common form of making an electrical connection, albeit a more permanent connection that that of a twisted wire, taped connection, involves placing the wires in a side-by-side relation or even twisting them as described above and permanently joining them together by melting and flowing a filler metal (solder) over the engagement location, the filler metal having a lower melting point than the adjoining metallic strands or core of the electrical wire. Although this form of connection can accommodate varying gauge sizes and wire types and sufficiently eliminate the wires ends from becoming loose over a period of time, the application time and care involved in making a proper connection may make it desirably less appropriate for widespread utilization where multiple connections must be made within a reasonable timeframe, notably, for example, electrical connections made during construction of a dwelling and the like.

Other common forms of making an electrical connection, generally existing between the twisted wire, taped connection and solder connection that respectively provide for simplicity and reliability, involve usage of a cap or nut connector of the type that twists onto the exposed wire ends that have been placed in a side-by-side, parallel relation and a crimped connector that relies on placing the exposed wire ends within a metallic conductive sleeve or barrel and deforming or squeezing the sleeve relatively around the bare wire ends to an appreciable degree by a hand-held crimping tool. Although each form of connection adequately serves to meet the primary objective of establishing a quick and reliable electrical connection for the most part, a degree of care must be exercised during the connector-installation process so as to establish a sufficient amount of surface contact and hold on the bare wire ends to ensure an appreciable level of electrical continuity through the connector.

For example, individual strands in an electrical wire composed of multiple strands may become fragmented, loosened or removed entirely from the electrical wire during the connector-installation process, such as by the mechanical action of twisting or crimping the connector onto the bare wire ends that can unduly yield less than optimum surface contact or hold for sustained electrical continuity through the connector. In other respects, since cap and crimped connectors by design depend on an applied, inward radial force to tightly hold together the bare wire ends, there are realistic opportunities that the use of either one may fail to sufficiently capture and compress together the collection of bare wire ends, perhaps from underturning or overturning the cap connector or failing to squeeze the crimped connector sleeve to an appreciable extent for ample hold on the bare wire ends. Regardless of this possible occurrence, conducting a field test can assess the hold strength of the electrical connector, which in most part simply involves gripping the connector and the wire ends and gently tugging on them in an opposing manner. If they come apart, the connection has failed and the connector-installation process must be reattempted until realizing a level of adequate hold. In yet another problem area, but perhaps more common with crimped connectors in particular, an insufficient crimp can leave air pockets between the bare wire ends and connector. Air pockets allow moisture to collect, moisture causes corrosion, corrosion causes resistance, and resistance causes heat, all of which can ultimately lead to breakage of the electrical wire and consequently the disruption of electrical continuity.

Although each of the above forms of making an electrical connection are widely known and commonly used in the art, some may not be entirely appropriate or suited for all or some applications, notably where the electrical wires requiring electrical connection may comprise differing gauge sizes and/or types. Electrical installation of a light fixture in a residential or commercial structure highlights the insufficient nature of some forms of electrical connections, particularly the usage of a cap connector that is commonly employed in this application.

It is quite common to observe in the art that light fixtures as well as other devices and appliances by design are manufactured with electrical wires that can significantly differ in terms of gauge size and type from those used in the electrical circuitry of a building structure. The mating of the electrical wire composed of multiple strands emanating from the light fixture to a solid core or single stranded wire made part of the electrical circuitry of a building can prove to be problematic in terms of yielding a reliable and secure connection. Often cap connectors of type previously mentioned are used in making the electric connections, and when they are improperly used or of the wrong size, the twisting action of the cap connector on the multiple strands against the solid core can damage the individual strands to the extent of breakage and unknowingly compromise the integrity of the connection and consequently the flow of electricity to the light fixture. Although a simple pull test as described above may possibly reveal the failed connection, often it is an overlooked, supplemental activity in the field.

Accordingly, there remains a need for an electrical connector that sufficiently accepts for connection electrical wires of varying gauge sizes and types, provides for the reliability and permanency of a soldered electrical connection and offers the simplicity and ease of a cap connector without calling into question the integrity of the electrical connection to maintain electrical continuity therethrough.

BRIEF SUMMARY OF THE INVENTION

In order to overcome the numerous drawbacks apparent in the prior art, an electrical wire connector has been devised for accepting and connecting stripped, bare portions of electrical wire, notwithstanding the gauge size and type, such as those categorically composed of multiple strands or a single strand or core.

It is an object of the present invention to provide an electrical wire connector that offers the reliability and permanency of a soldered wire connection without having to resort to usage of specially configured hand-held tools in the form that may cause injury, such as a heating iron for completing soldering operations, for example.

It is a further object of the present invention to provide an electrical wire connector that offers the ease and simplicity of installing a cap or nut connector onto bare wire ends, while having the further opportunity to visually assess the adequacy of the surface contact of the electrical connection to yield optimum and reliable electrical continuity therethrough.

It is yet another object of the present invention to provide an electrical wire connector that can adequately withstand a degree of opposing pull force on the ends of the electrical wire and yet sustain a reliable and secure electrical connection.

It is a further object of the present invention to provide an electrical wire connector that can be fabricated from a variety of materials, such as nickel-plated steel, copper, aluminum as well as other conductive metals, to optimize electrical flow through the connector.

It is yet another object of the present invention to provide an electrical wire connector that can sufficiently accommodate a variety of electrical connections typically present in circuitry of residential and commercial structures, including applications involving low voltage loads.

It is yet another object of the present invention to provide an electrical wire connector that is adaptable for use in outdoor applications as well as moisture-laden environments without unduly compromising the integrity of the electrical connection.

It is yet another object of the present invention to provide an electrical wire connector that is economical in terms of time and expense in making a proper and reliable electrical connection as compared to the other competing devices generally known and available the art.

In accordance with the present invention an electrical wire connector has been devised for physically connecting and electrically coupling together a plurality of electrical wires, notwithstanding the gauge size and type, the electrical wire connector principally comprising a bridging member having a midsection interposed between a pair of sectional ends each having a lower jaw element integral thereto and an upper jaw element pivotally connected thereto to collectively form a clamp mechanism for receiving a bare portion of electrical wire and a torsion spring selectively positioned between the lower and upper jaw elements for applying a downward clamping force sufficiently capable of retaining the bare portion of electrical wire within the confines of the clamp mechanism, the clamp mechanism further comprising primary, secondary and tertiary slots integrated within the structure of the lower and upper jaw elements for accepting and engaging therewithin an extended section of the bare portion of electrical wire to effect resistance of tensional or pull forces applied thereto so as to provide for a permanent-like connection that maintains continuity through the electrical wire connector.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a device in the form of an electrical wire connector that sufficiently serves to physically connect and electrically couple together a plurality of electrical wires to fulfill continuity along one or more electrical wire paths, regardless of the gauge size and type of electrical wire, such as those categorically composed of multiple strands or a single strand or core.

Figure 1:
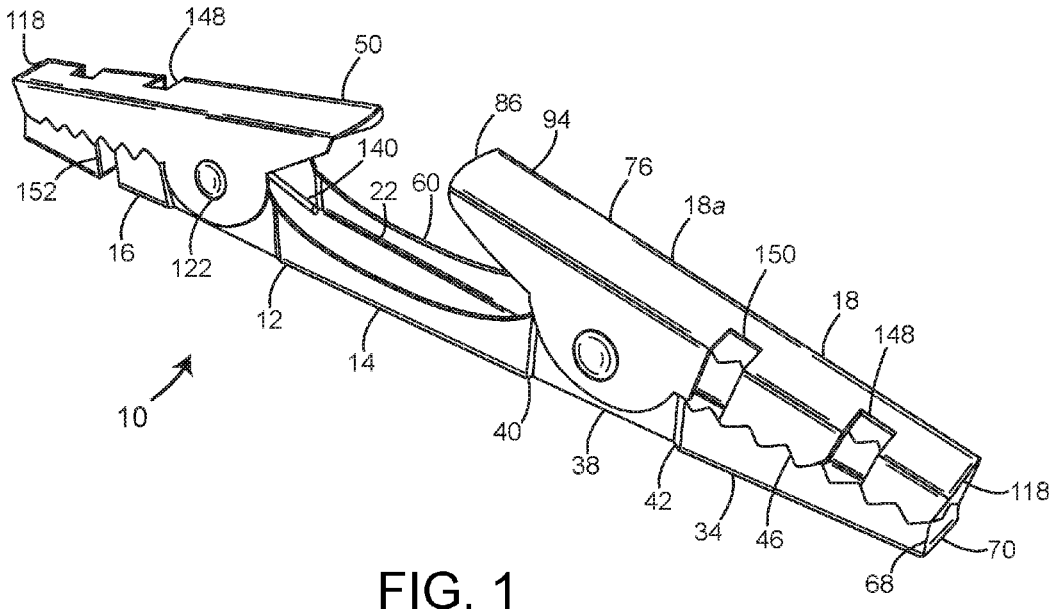
FIG. 1 is a side perspective view of the preferred embodiment of the present invention illustrating a bridging member comprising a pair of sectional ends each having a lower jaw element integral thereto and an upper jaw element pivotally connected to the lower jaw element to collectively form a clamp mechanism.

Referring now to FIG. 1, there is shown generally at 10 an electrical wire connector comprising a bridging member 12 having a midsection 14 interposed between a pair of sectional ends 16 each being equipped with a clamp mechanism 18 of the type suited for receiving and clamping onto a bare or stripped portion 20*a* of electrical wire 20. The bridging member is further shown in FIGS. 1 and 2 as comprising a lower planar component 22 having first and second edges 24, 26 and a pair of square-shaped ends 28 and a perimeter wall 30 extending upwardly from and being connected along the perimeter of the lower planar component to form an elongate cavity 32 about its length.

Although this disclosure describes in detail a bridging member 12 having a pair of sectional ends, it is equally understood within the context of this disclosure that the present invention may incorporate multiple bridging members each having two sectional ends adaptively equipped with clamp mechanisms that sufficiently fulfill connection of multiple ends of electrical wire, such to the extent as possibly serving as an electrical junction for accommodating the development of multiple electrical paths in an electrical circuit. For example, it is conceivable within the scope of this disclosure that a pair of bridging members may be arranged in a cross-shaped pattern generating four sectional ends each being adaptively configured with a clamp mechanism of the type particularly disclosed and described herein to preferentially form a four-way electrical connection.

Figure 2:
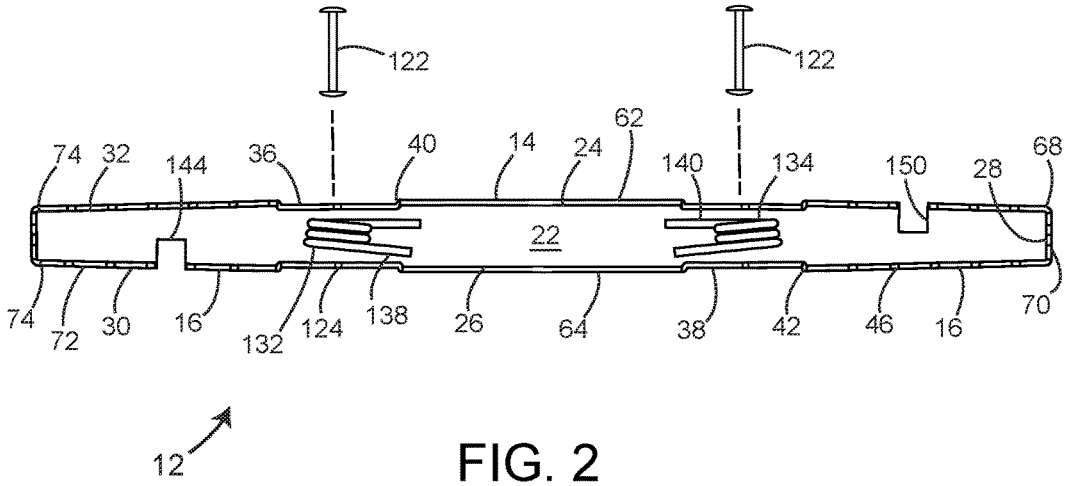
FIG. 2 is a top plan view of the preferred embodiment of the present invention illustrating a pair of torsion springs positioned within an elongate cavity of a bridging member.
Figure 3:
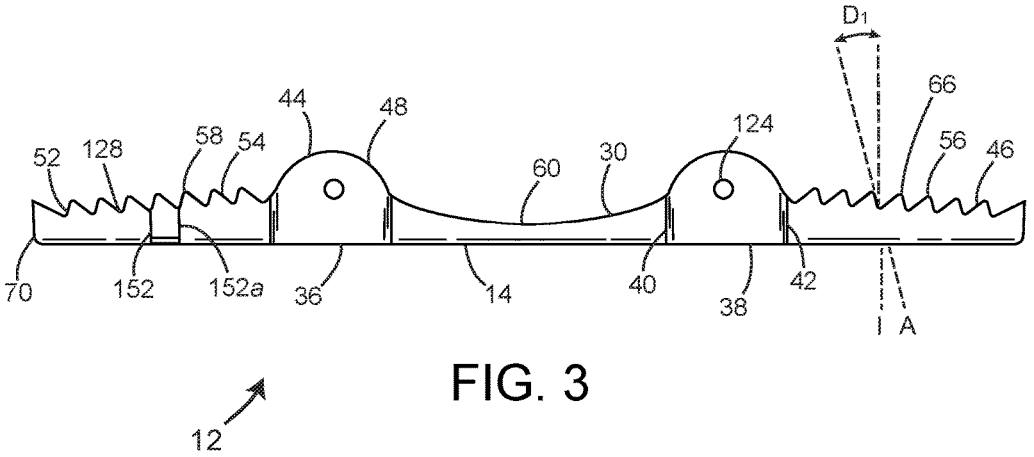
FIG. 3 is a front elevational view of the preferred embodiment of the present invention a bridging member having a pair of lower jaw elements integral to a pair of clamp mechanisms.
Figure 4:
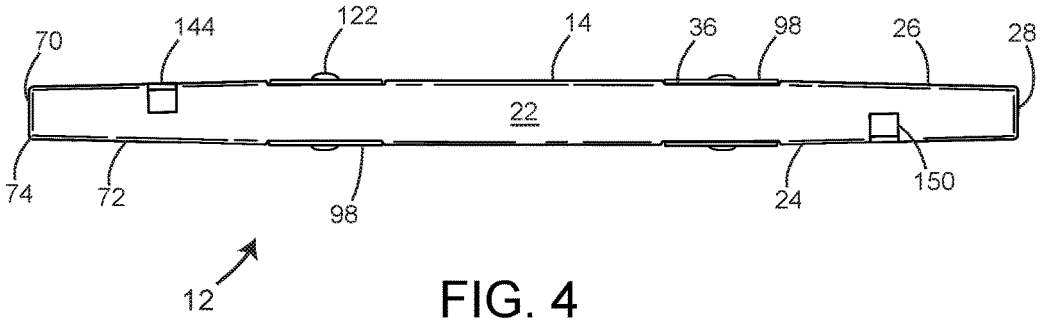
FIG. 4 is a bottom plan view of the preferred embodiment of the present invention illustrating a bridging member comprising a lower planar component having first and second edges and a pair of square-shaped ends.

Now in further reference to FIGS. 2 and 3, a lower jaw element 34 integral to the structure of the clamp mechanism 18 and comprising a pair of indentations 36 are preferentially shown as being integrated within the structure of the perimeter wall 30 present at each sectional end 16, whereby each indentation is further shown as having an inward wall 38 bounded by innermost and outermost walls 40, 42. The indentations at each sectional end are generally arranged to oppose one another such that the inward walls made part thereof substantially extend in a parallel manner A curvilinear portion 44 of the inward wall preferably resides within the innermost and outermost walls and extends relatively above a plurality of upwardly facing teeth 46 integral to the lower jaw element 34 so as to form a lower hinging element 48 suited for connecting an upper jaw element 50 as supplementally associated with the clamp mechanism 18. The upwardly facing teeth integrated within the structure of the perimeter wall 30 are generally shown in FIGS. 2 and 3 as extending from the outermost wall 42 of one indentation and continuing therealong to the other outermost wall of the opposing indentation. Each tooth of the upwardly facing teeth 46 comprises first and second angular components 52, 54 converging to a vertex 56, whereby the first angular component is angularly orientated or pitched toward the midsection 14 of the bridging member a predetermined amount to form a reverse- or an inward-pitched tooth 58, as generally represented in FIG. 3 by line A in angular deviation $D_1$ from axis I extending perpendicular or normal to the lower planar component. In further association with the bridging member, the perimeter wall at the midsection is shown in FIGS. 2 and 3 as comprising a downward curvilinear portion 60 that generally extends from the innermost walls 40 of the indentations 36 residing on a first side 62 of the bridging member as well as on a second side 64 thereof such that the opposing perimeter walls at and along the midsection 14 are substantially arranged in a parallel manner. Comparatively, the perimeter wall at and along each sectional end 16 comprising the upwardly facing teeth 46 is generally shown in FIG. 3 as being geometrically configured with a downward taper 66 extending from the outermost walls 42 to a pair of corners 68 of a lower nose segment 70 associated with each sectional end. Similarly, the lower planar component 22 as shown in FIG. 4 is geometrically configured with an inward taper 72 extending along the first and second edges 24, 26 from the opposing position of the outermost walls to a pair of corners 74 integrally forming the square-shaped end of the lower planar component such that the perimeter wall along the first and second sides comprising the upwardly facing teeth 46 inwardly tapers a predetermined amount from the opposing position of the outermost walls 42 of the indentations 36 to the corners 68 of the lower nose segment.

Figure 5:
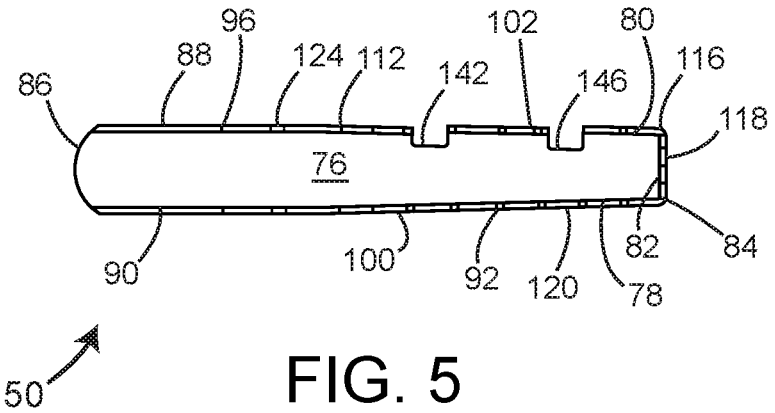
FIG. 5 is a bottom plan view of the preferred embodiment of the present invention illustrating an upper jaw element integral to a clamp mechanism and having primary and tertiary slots for accepting therewithin an extended section of a bare portion of electrical wire.
Figure 6:
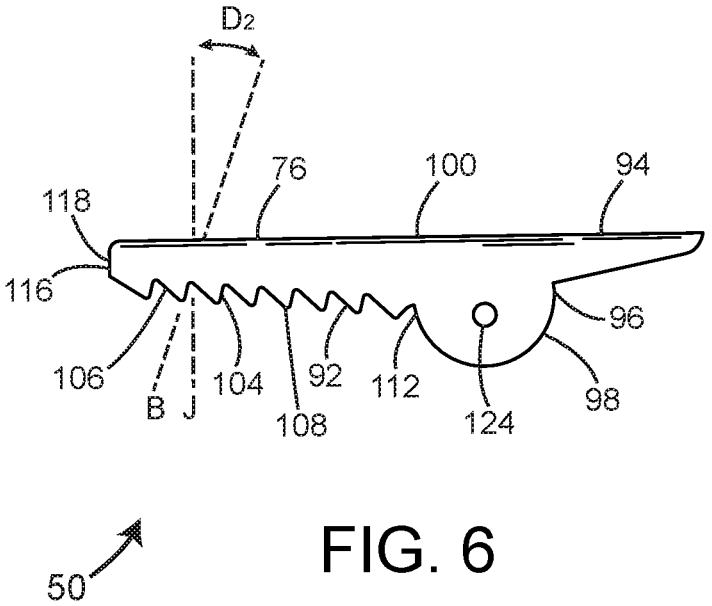
FIG. 6 is a front view of the preferred embodiment of the present invention illustrating an upper jaw element integral to a clamp mechanism and having a plurality of downwardly facing teeth and an upper hinging element.
Figure 7:
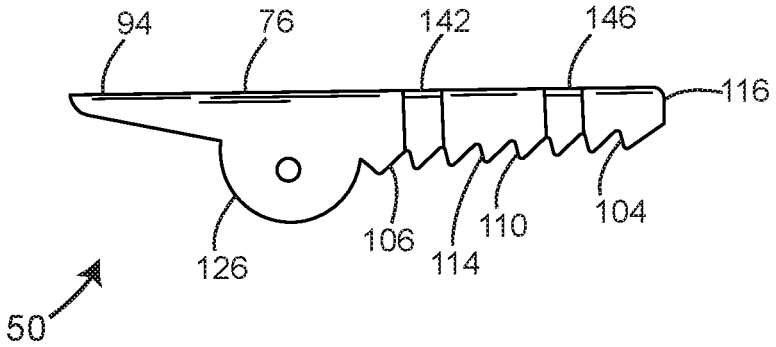
FIG. 7 is a back view of the preferred embodiment of the present invention illustrating an upper jaw element integral to a clamp mechanism and having primary and tertiary slots for accepting therewithin an extended section of a bare portion of electrical wire.

Referring now to FIG. 5, the upper jaw element 50 is shown therewithin as comprising an upper planar component 76 having first and second edges 78, 80, a square-shaped end 82 with a pair of corners 84 and an arcuate-shaped end 86 and a perimeter wall 88 extending downwardly from the first and second edges and square-shaped end to form an open-ended cavity 90. In further association with the upper jaw element is a plurality of downwardly facing teeth 92 integrated with the perimeter wall thereof and a cantilevered arm 94 that extends outwardly from inward sides 96 of a pair of upper hinging elements 98 that oppose one another, with each being respectively present on first and second sides 100, 102 of the upper jaw element 50, as generally represented in FIGS. 5, 6 and 7. Each tooth of the downwardly facing teeth, like the upwardly facing teeth 46 associated with the lower jaw element 34, comprises first and second angular components 104, 106 converging to a vertex 108, whereby the first angular component is angularly orientated or pitched toward the midsection of the bridging member a predetermined amount to form a reverse-pitched tooth 110, as generally represented in FIG. 6 by line B in angular deviation $D_2$ from axis J extending perpendicular or normal to the upper planar component. In further respects, the downwardly facing teeth 92 as integrated within the perimeter wall are generally shown in FIGS. 5 and 6 as extending from an outward side 112 of one of the upper hinging elements and continuing therealong to an outward side of the opposing upper hinging element. Like the lower jaw element, the perimeter walls along the first and second sides 100, 102 of the upper jaw element comprising the downwardly facing teeth 92 are geometrically configured with a downward taper 114 that extends from the outward sides 112 of the upper hinging elements to a pair of corners 116 of an upper nose segment 118. As equally shown in FIG. 5, the upper planar component 76 is geometrically configured with an inward taper 120 extending along the first and second edges 78, 80 from the opposing position of the outward sides of the upper hinging elements 98 to the corners 84 of the square-shaped end 82 of the upper planar component such that the perimeter wall along the first and second sides comprising the downwardly facing teeth 92 inwardly tapers a predetermined amount from the opposing position of the outward sides of the upper hinging elements to the corners 116 of the upper nose segment 118.

Figure 8:
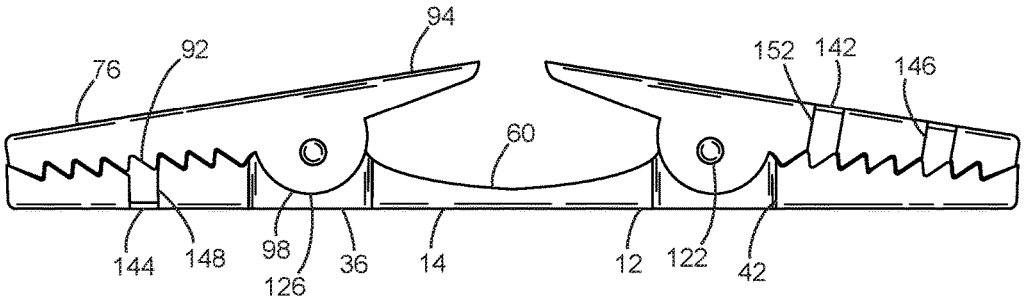
FIG. 8 is a front elevational view of the preferred embodiment of the present invention illustrating a bridging member comprising a pair of sectional ends each having a lower jaw element integral thereto and an upper jaw element pivotally connected to the lower jaw element to form a clamp mechanism and primary, secondary and tertiary slots integrated within the structure of the lower and upper jaw elements.
Figure 8:
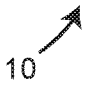
Figure 9:
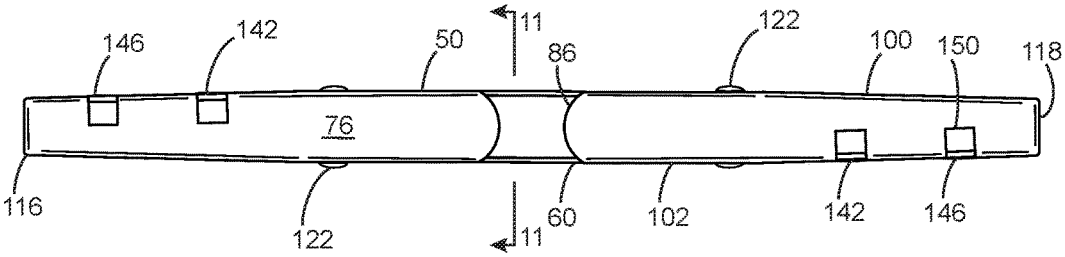
FIG. 9 is a top plan view of the preferred embodiment of the present invention illustrating a pair of upper jaw elements connected to and situated above a bridging member.
Figure 9:
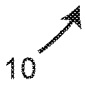
Figure 10:
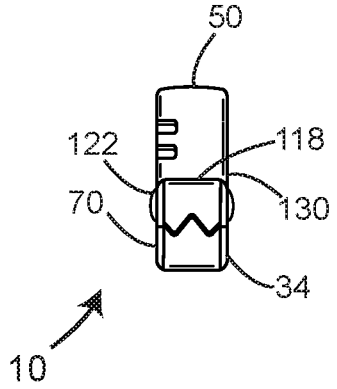
FIG. 10 is a left end view of the preferred embodiment of the present invention illustrating an upper jaw element positioned above and engaging a lower jaw element to collectively form a clamp mechanism.

In further reference to FIG. 8, each upper jaw element 50 is pivotally connected to its respective lower jaw element 34 by means of the overlapping placement of the upper and lower hinging elements and fastening the overlapping structures with a pin 122 in the preferred form of a rivet or equivalent selectively configured to pass through a pair of aligned apertures 124 extending through the lower and upper hinging elements, whereby the upper hinging elements 98, each generally shown to comprise a curvilinear portion 126 extending beyond the downwardly facing teeth 92 and cantilevered arm 94, reside within the confines of the opposing indentations 36 present at the sectional end 16 and generally associated with the lower jaw element. Accordingly, the resultant placement of the upper and lower jaw elements provides a complementary relationship of the upwardly and downwardly facing teeth to grasp onto the bare portion 20*a* of electrical wire, namely where each tooth of the upwardly facing teeth engagingly reside within the confines of a triangulated space 128 present between each tooth of the downwardly facing teeth and vice versa, and the cantilevered arm 94 extends above the midsection 14 of the bridging member 12, typically in the manner illustrated in FIGS. 8 and 9. Moreover, in combination of the above, the resultant configuration of the downward and inward tapers associated with the perimeter walls comprising the upwardly and downwardly facing teeth 46, 92, collectively forming a tapered snout 130 of the type shown in FIG. 10, and the reverse pitch 58, 110 of the teeth fulfill to offer a firm grasp on the bare portion 20*a* of electrical wire 20 to mitigate any occurrence of inadvertent pullout as the electrical wire adversely experiences an applied tensional or pull force.

Figure 11:
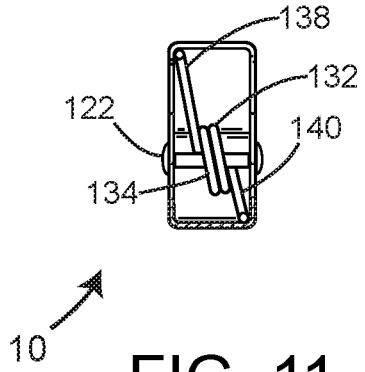
FIG. 11 is a cross sectional view of the preferred embodiment of the present invention taken along lines 11-11 in FIG. 9 illustrating a torsion spring positioned in between lower and upper jaw elements integral to a clamp mechanism.
Figure 12:
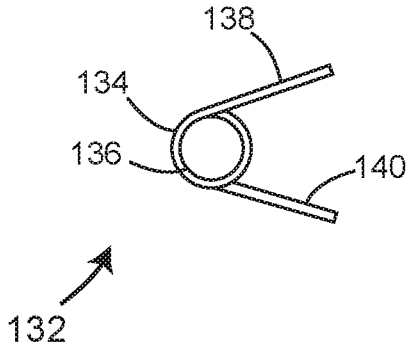
FIG. 12 is a side elevational view of the preferred embodiment of the present invention illustrating a torsion spring having a coil and upper and lower ends emanating therefrom.

In fulfilling an inherent downward clamping force between the lower and upper jaw elements 34, 50 such to sufficiently provide for a firm grasp on the bare portion of electrical wire, each clamp mechanism 18 is shown in FIGS. 1 and 2 as supplementally comprising a torsion spring 132 of the type having a coil 134 with an opening 136 extending therethrough and upper and lower ends 138, 140 diametrically positioned and emanating from one side of the coil. In application, the torsion spring is generally allowed to reside within the simultaneous confines of the elongate cavity 32 of the bridging member and open-ended cavity 90 of the upper jaw element insofar to allow the pin 122 associated with the connection of the hinging elements to pass through the opening 136 provided in the coil, as generally depicted in FIGS. 11 and 12. Consequently, the upper and lower ends of the coil will be directionally orientated toward the midsection 14 of the bridging member that allows them to respectively abut against and simultaneously engage the lower and upper planar components 22,76, as typically represented in FIG. 11. An applied downward force on the cantilevered arm 94 in the direction of arrow A in FIG. 13 will move or compress the upper and lower ends 138, 140 of the torsion spring together and allow the upper jaw element to pivotally rotate relatively about the pin and angularly separate from the lower jaw element along path A in FIG. 13, particularly as such to openly accommodate and receive the bare portion 20*a* of electrical wire 20. Contrariwise, release of the cantilevered arm 94 will allow the upper and lower ends to move to their equilibrium state by means of the inherent spring characteristics associated with the torsion spring 132 and consequently close the upper and lower jaw elements together to firmly hold and grasp the bare portion of electrical wire typically in the manner shown in FIG. 14.

Figure 13:
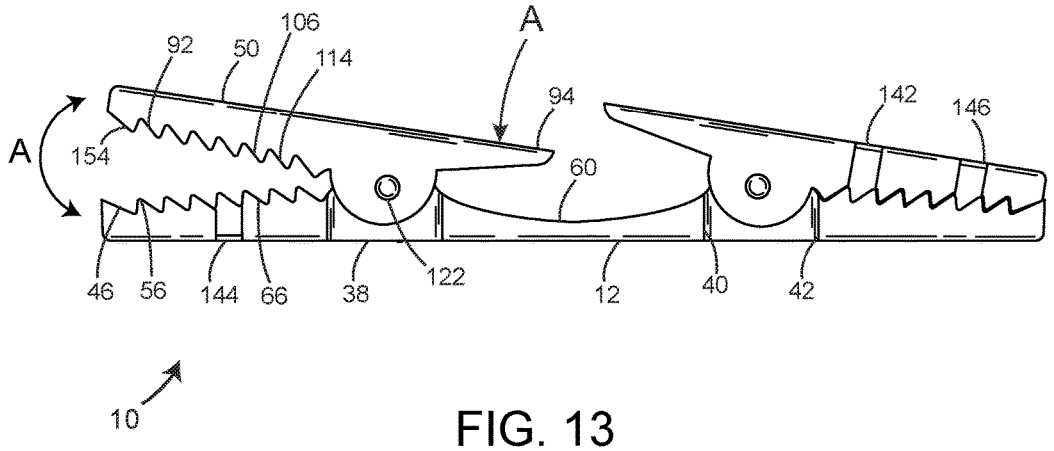
FIG. 13 is a front elevational view of the preferred embodiment of the present invention illustrating an upper jaw pivotally positioned apart and movable along path A from a lower jaw element integrated within a sectional end of a bridging member.

In supplementing the clamp mechanism's capacity to retain the bare portion of electrical wire 20 within the upper and lower jaw elements, the clamping mechanism 18 is further shown in FIG. 13 as comprising restraint means in the form of a plurality of slots integrated within the structure of the upper and lower jaw elements, preferably comprising primary, secondary and tertiary slots 142, 144, 146. As shown in FIG. 7, the primary and tertiary slots 142, 146 are integral to the structure of the upper jaw element 50, where each slot is geometrically configured as an L-shaped cutout 148 that encompasses the corner formed by the upper planar component and adjoining perimeter wall. Likewise, as represented in FIGS. 3 and 4, the secondary slot 144 is integral to the structure of the lower jaw element 34 and is geometrically configured as a L-shaped cutout that encompasses the corner formed by the lower planar component and adjoining perimeter wall. As generally illustrated in FIGS. 1, 3 and 6, each L-shaped cutout 148 comprises a horizontal component 150 that adjoins to a vertical component 152 extending through the perimeter wall and having parallel edges 152*a* perpendicularly orientated to the upper and lower planar components.

Figure 14:
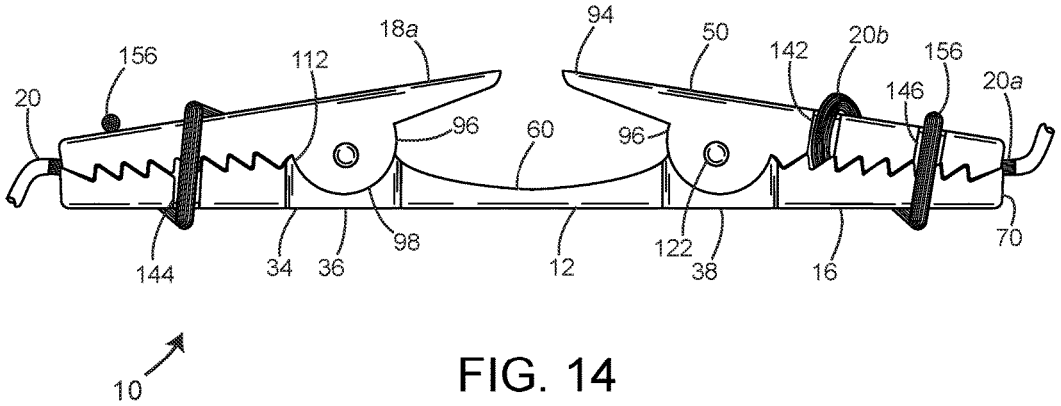
FIG. 14 is a front elevational view of the preferred embodiment of the present invention illustrating extended sections of bare portions of a pair of electrical wires engaged within a pair of clamp mechanisms and selectively positioned and held within primary, secondary and tertiary slots structurally associated with the clamp mechanism.

As will be described downbelow in view of accompanying FIG. 14, the designation assigned to each of the slots dictates the preferential order by which the bare portion 20*a* of electrical wire passes and engages the slots to securely retain its position with the hold of the clamp mechanism 18 comprising the upper and lower jaw elements. Furthermore, by way of briefly describing the manner in which the bare portion of electrical wire engages the slots, one may appreciably gain further insight into the relatedness and interaction of the operative components discussed thus far that principally fulfill the utilitarian objects of the present invention.

In fulfilling physical connection of the bare portion of electrical wire 20 by means of the electrical wire connector 10, the cantilevered arm 94 is initially depressed downward to the extent of angularly repositioning the lower and upper jaw elements 34, 50 apart from one another along path A in FIG. 13 to form a receiving throat 154. Given the presence of the downward curvilinear portion 60 of the midsection 14, the cantilevered arms 94 are capable of moving downwardly to a sufficient extent below the curvilinear portion of the lower hinging element without undue structural hindrance from the bridging member 12, particularly as such to accommodate larger gauge sizes of electrical wire if deemed necessary. An extended section 20*b* of the bare portion of electrical wire is then placed within the confines of the receiving throat 154 such to lineally extend beyond the sectional end 16 a predetermined amount. A select section of the bare portion is preferably bent sideward so as to exteriorly pass through the primary slot 142 of the upper jaw element, after which time the upper and lower jaw elements are permitted to close relatively around the electrical wire 20 by means of releasing the cantilevered arm under the force of the torsion spring 132. Subsequently, the extended section of the bare portion 20*a* of electrical wire is bent to a further degree to wind or wrap relatively around an exterior portion 18*a* of the clamp mechanism 18 to enable reach into the secondary slot 144 of the lower jaw element, as illustrated in FIG. 14. A terminal part 156 of the bare portion of electrical wire is finally bent upward to pass into and engage accordingly within the confines of the tertiary slot 146 of the upper jaw element 50. By means of the resultant winding of the extended section of the bare portion of electrical wire within the provided slots as shown in FIG. 14, a permanent-like connection is made to prevent inadvertent release of the electrical wire 20 from the hold of the clamping mechanism 18, even more so by the presence of the L-shaped cutout 148 comprising the horizontal component 150 that further effects resistance to tensional or pull forces applied to the electrical wire.

Figure 15:
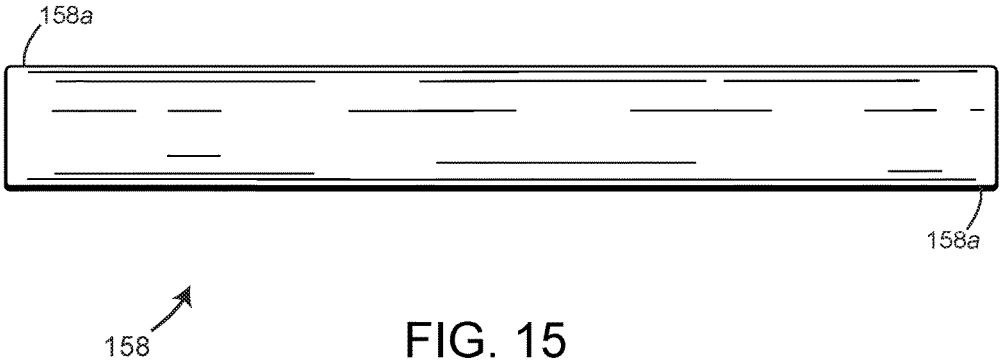
FIG. 15 is a front elevational view of the preferred embodiment of the present invention illustrating a flexible insulating sleeve cylindrically configured to slidably fit over a pair of clamp mechanisms structurally connected together by a bridging member.
Figure 16:
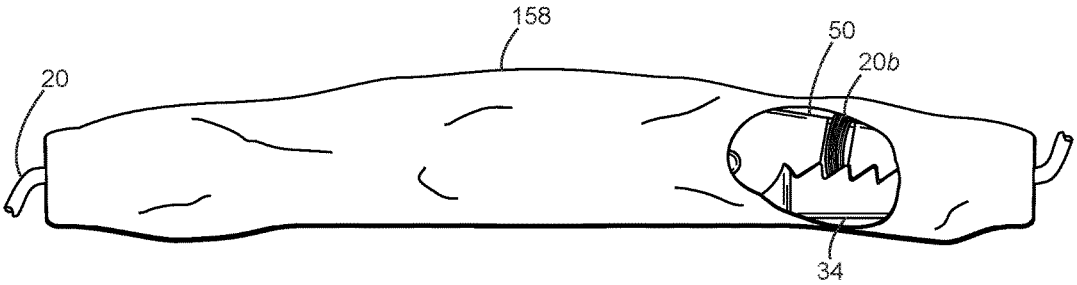
FIG. 16 is a front elevational view of the preferred embodiment of the present invention illustrating a flexible insulating sleeve slidably positioned over a pair of clamp mechanisms connected together by a bridging member and further illustrating a cutaway depicting partial representation of an extended section of a bare portion of electrical wire engagingly positioned within a primary slot.

After consummating the electrical connection as described above and generally represented in FIG. 14, the electrical wire connector assembly may be covered and protected by a flexible insulating sleeve 158 of the type that is fabricated from non-conductive materials, such as polyethylene, polyurethane, silicone, or rubber. The sleeve, as shown in FIG. 15, is preferably arranged to extend equal distant beyond the lower and upper nose segments 70, 118 of the electrical connector 10 a predetermined amount so as to eliminate possible contact with neighboring conductive materials. Since the sleeve 158 comprises inherent flexibility characteristics and the winding of the electrical wire 20 has the effect to retain closure of the upper and lower jaw elements, the integrity of the electrical connection is not unduly compromised by the action of slidably placing the sleeve over the electrical wire connector assembly, such as in the manner shown in FIG. 16. In supplementing the protective characteristics of the sleeve, ends 158*a* of the sleeve may receive therewithin a pliable sealant (not shown) that fully encapsulates and protects the electrical wire connector from moisture intrusion so as to allow use of the electrical wire connector in outdoor applications or water-laden environments, for example.

As it can be seen from the foregoing there is provided in accordance with this invention a simple and easily operated device for physically connecting and electrically coupling together bare portions 20*a* of electrical wire 20 to establish continuity along one or more electrical wire paths, notwithstanding the type and gauge size of electrical wire necessitating connection. It is obvious that the components comprising the electrical wire connector 10 may be fabricated from a variety of materials, providing such selection or use of materials possesses the capacity to conduct electrical current sufficiently suited for operation of electrical appliances and devices connected to an electrical circuit by means of the electrical wire connector 10. Accordingly, it is most desirable, and therefore preferred, to construct the electrical wire connector 10, namely, the bridging member 12 and clamping mechanism 18 comprising the lower and upper jaw elements 34, 50 from nickel plated steel or an equivalent type of conductive material that sufficiently affords long-term use, durability and reliability.

Although this disclosure describes the present invention being useful for connecting electrical wire 20 of varying types (such as multiple- or single-stranded wire) and differing gauge sizes within a reasonable range, there may be instances where the electrical wire is exceedingly small or large in diameter. Accordingly, it is well within the scope of this disclosure that the present invention may be appropriately sized or scaled to accommodate the foregoing conditions to yield the full utilitarian benefits described herein. Furthermore, it is understood within the context of the present invention that restraint means may comprise slots of alternative geometric configuration and/or a greater or lesser number of slots than described for the preferred embodiment of the invention to accommodate, as well, the construct or type of electrical wire or the sustainable holding requirements of the clamp mechanism 18 that sufficiently overcomes applied tensional forces on the electrical wire.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. An electrical wire connector for electrically coupling together a plurality of electrical wires each having a bare portion, said connector comprising, in combination:

a bridging member having a midsection interposed between a pair of sectional ends collectively fixed in a linear arrangement, each of said sectional ends having a lower jaw element integral thereto;

an upper jaw element pivotally connecting to and residing above said lower jaw element to form a clamp mechanism capable of receiving the bare portion of the electrical wire;

a torsion spring situated in between said lower and upper jaw elements for applying a downward clamping force on the bare portion of the electrical wire confined within said clamp mechanism; and restraint means for supplementally restraining the release of the bare portion of the electrical wire from the hold of said clamp mechanism.

2. The electrical wire connector as set forth in claim 1, wherein said lower and upper jaw elements respectively comprise a plurality of upwardly and downwardly facing teeth for clampingly engaging the bare portion of the electrical wire.

3. The electrical wire connector as set forth in claim 2, wherein each tooth of said upwardly and downwardly facing teeth comprises first and second angular components converging to a vertex, whereby said first angular component is angularly orientated toward said midsection of the bridging member.

4. The electrical wire connector as set forth in claim 1, wherein said bridging member comprises a lower planar component having a perimeter wall extending upwardly from and being connected along a perimeter portion of the lower planar component to form an elongate cavity.

5. The electrical wire connector as set forth in claim 1, wherein said restraint means comprises a plurality of slots integrated within the structure of said clamp mechanism capable of passing through and receiving an extended section of the bare portion of electrical wire.

6. The electrical wire connector as set forth in claim 5, wherein each of said slots is geometrically configured as an L-shaped cutout.

7. The electrical wire connector as set forth in claim 1, wherein said lower and upper jaw elements respectively comprise lower and upper hinging elements each having an aperture extending therethrough for receiving therewithin a pin to allow pivotal movement of said upper jaw element relatively from said lower jaw element.

8. The electrical wire connector as set forth in claim 7, wherein said upper jaw element comprises a cantilevered arm integrally connecting to and extending from said upper hinging element.

9. The electrical wire connector as set forth in claim 1, wherein said upper jaw element comprises an upper planar component having first and second edges, a square-shaped end with a pair of corners and an arcuate-shaped end, said upper planar component further comprising a perimeter wall extending downwardly from said first and second edges and said square-shaped end to form an open-ended cavity.

10. The electrical wire connector as set forth in claim 1, further comprising a flexible insulating sleeve slidably positioned over an assembly comprising said bridging member and said clamp mechanisms, wherein said flexible insulating sleeve extends equal distantly beyond a pair of lower nose segments of the sectional ends a predetermined amount.

11. An electrical wire connector for electrically coupling together a plurality of electrical wires each having a bare portion, said connector comprising, in combination:

a bridging member having a midsection interposed between a pair of sectional ends collectively fixed in a linear arrangement, each of said sectional ends having a lower jaw element integral thereto;

an upper jaw element pivotally connecting to and residing above said lower jaw element to form a clamp mechanism capable of receiving the bare portion of the electrical wire, said upper jaw element having primary and tertiary slots and said lower jaw element having a secondary slot collectively capable of passing through and receiving an extended section of the bare portion of electrical wire; and a torsion spring situated in between said lower and upper jaw elements for applying a downward clamping force on the bare portion of the electrical wire confined within said clamp mechanism.

12. The electrical wire connector as set forth in claim 11, wherein said lower and upper jaw elements respectively comprise a plurality of upwardly and downwardly facing teeth for clampingly engaging the bare portion of the electrical wire.

13. The electrical wire connector as set forth in claim 11, wherein said lower and upper jaw elements respectively comprise lower and upper hinging elements each having an aperture extending therethrough for receiving therewithin a pin to allow pivotal movement of said upper jaw element relatively from said lower jaw element.

14. The electrical wire connector as set forth in claim 13, wherein said bridging member comprises a lower planar component having a perimeter wall extending upwardly from and being connected along a perimeter portion of the lower planar component to form an elongate cavity and said upper jaw element comprises an upper planar component having first and second edges, a square-shaped end, an arcuate-shaped end, and a perimeter wall extending downwardly from said first and second edges and said square-shaped end to form an open-ended cavity.

15. The electrical wire connector as set forth in claim 14, wherein said torsion spring comprises a coil having an opening extending therethrough and upper and lower ends diametrically positioned and emanating from one side of the coil, said torsion spring being positioned to simultaneously reside within said elongate cavity and said open-ended cavity so as to allow said pin to pass through said opening of the coil.

16. The electrical wire connector as set forth in claim 15, wherein said upper jaw element comprises a cantilevered arm integrally connecting to and extending from said upper hinging element for opening said clamp mechanism and compressing together said upper and lower ends respectively in engagement with said upper and lower planar components.

17. The electrical wire connector as set forth in claim 14, wherein each of said primary, secondary and tertiary slots is geometrically configured as an L-shaped cutout, said L-shaped cutouts associated with said primary and tertiary slots each having horizontal and vertical components respectively extending through said upper planar component and adjoining perimeter wall, said L-shaped cutout associated with said secondary slot having horizontal and vertical components respectively extending through said lower planar component and adjoining perimeter wall.

18. An electrical wire connector for electrically coupling together a plurality of electrical wires each having a bare portion, said connector comprising, in combination:

a bridging member having a midsection interposed between a pair of sectional ends collectively fixed in a linear arrangement, each of said sectional ends having a lower jaw element integral thereto, said bridging member comprising a lower planar component having a perimeter wall extending upwardly from and being connected along a perimeter portion of the lower planar component to form an elongate cavity, said lower jaw element having a plurality of upwardly facing teeth integrated within said perimeter wall of the bridging member;

an upper jaw element pivotally connecting to and residing above said lower jaw element to form a clamp mechanism for receiving the bare portion of the electrical wire, said upper jaw element comprising an upper planar component having first and second edges, a square-shaped end, an arcuate-shaped end, and a perimeter wall extending downwardly from said first and second edges and said square-shaped end to form an open-ended cavity, said upper jaw element having a plurality of downwardly facing teeth integrated within said perimeter wall thereof; and a torsion spring having upper and lower ends diametrically positioned and emanating from one side thereof toward said midsection, said torsion spring being positioned to simultaneously reside within said elongate cavity and said open-ended cavity so as to allow said upper and lower ends to respectively engage said upper and lower planar components.

19. The electrical wire connector as set forth in claim 18, wherein said upper jaw element comprises primary and tertiary slots and said lower jaw element comprises a secondary slot collectively capable of receiving an extended section of the bare portion of electrical wire, whereby the extended section engages and passes through said primary slot and wraps relatively about an exterior portion of the clamp mechanism to fit within and engage said secondary slot followed by said tertiary slot.

20. The electrical wire connector as set forth in claim 18, wherein said lower and upper jaw elements respectively comprise lower and upper hinging elements each having an aperture extending therethrough for receiving therewithin a pin to allow pivotal movement of said upper jaw element relatively from said lower jaw element, said upper jaw element having a cantilevered arm integrally connecting to and extending from said upper hinging element for opening said clamp mechanism and compressing together said upper and lower ends respectively in engagement with said upper and lower planar components.

* * * * *